US005516103A

United States Patent [19]

Lawlor et al.

[11] Patent Number: 5,516,103

[45] Date of Patent: May 14, 1996

[54] DUAL FUNCTION DROP TARGET FOR PINBALL GAME

[75] Inventors: Patrick Lawlor; John Krutsch, both of Chicago, Ill.

[73] Assignee: Williams Electronics Games, Inc., Chicago, Ill.

[21] Appl. No.: 505,618

[22] Filed: Jul. 21, 1995

[51] Int. Cl.[6] ..... A63F 7/30

[52] U.S. Cl. ..... 273/127 R; 273/118 R; 273/121 R; 273/121 A

[58] Field of Search ..... 273/118, 119, 273/121, 127 R

[56] References Cited

U.S. PATENT DOCUMENTS

| | | | |
|---|---|---|---|
| 3,927,884 | 12/1975 | Glass et al. | 273/127 R X |
| 4,257,604 | 3/1981 | Grabel et al. | 273/127 R |
| 4,773,646 | 9/1988 | Joos, Jr. et al. | 273/121 A |
| 4,804,186 | 2/1989 | Moravec | 273/121 AX |
| 4,968,031 | 11/1990 | Kaminkow et al. | 273/121 A |

*Primary Examiner*—Raleigh W. Chiu
*Attorney, Agent, or Firm*—Rockey, Rifkin and Ryther

[57] ABSTRACT

A ramp element is provided on the top of a drop target member so that when the target is activated and moved to its lower position, the ramp is accessible by the game ball and may travel thereover to reach elevated game features. A series of ramp elements may be provided in a row so that when all targets have been lowered, there is provided a ramp of increased size providing increased access to the elevated game feature.

6 Claims, 3 Drawing Sheets

DUAL FUNCTION DROP TARGET FOR PINBALL GAME

BACKGROUND OF THE INVENTION

The invention relates to the field of amusement devices, particularly rolling ball games and more specifically, to drop targets and ramp elements provided as playfield features.

Rolling ball games, including pinball games, typically include an inclined playfield housed within a game cabinet and having mounted thereon, a number of playfield features such as bumpers, ramps, targets, slots and the like. The playfield features influence the motion of the game ball, which is projected towards the features by flippers that are controlled by the game player. Pinball games appeal to players because of the novel arrangement of game features that make the game challenging and exciting to play. Generally, increased interaction between the player and the game means increased appeal. As players become more skilled at a particular game, however, the game loses its challenge and appeal. In order to maintain player interest and to satisfy the needs of the pinball game markets, novel game features and arrangements are constantly required.

Drop targets are a popular pinball game playfield feature. They typically consist of a planar plastic target element which rises through a slot in the game playfield. The target is movable between a raised and lowered position and is activated by striking it with the game ball. The target element is equipped with a catch mechanism below the playfield so that when the target is in its raised position and struck by the game ball, the catch is displaced and the target element, under spring tension, is retracted into the playfield and hidden from the player's view. At an appropriate time, a reset mechanism, which usually incorporates a solenoid, forces the target back to a position where it projects from the playfield and resets the catch mechanism. For examples of prior art drop targets, see U.S. Pat. Nos. 4,943,061 and 4,257,604 which are hereby incorporated by reference.

Some pinball games are equipped with elevated play features, including, for example, a smaller playfield elevated above the main playfield. Access to such elevated features is provided by ramp elements or other devices which may lift the ball from one playfield to the higher one. Typically, a player must activate a combination of features to allow the game ball access to the elevated playfield. Such arrangements usually require elaborate mechanical features or intricate ramp elements and are therefore, somewhat costly and complex to manufacture (see, for example, U.S. Pat. No. 4,848,748 to Krutsch and U.S. Pat. No. 5,120,058 to Trudeau et al). Moreover, such devices occupy a relatively large portion of the playfield or at least hide a portion of it from the player's view, thereby limiting the number of other features that may be incorporated on the playfield or reducing the player's ability to track the game ball as it rolls.

There is thus desired a device for permitting the game ball to access an elevated playfield or other elevated game feature, which device is simple to manufacture and occupies minimal playfield space and which is easily adaptable to existing playfield features.

It is accordingly an object of the present invention to provide an improved drop target which when activated, permits access to an elevated game feature.

It is another object of the present invention to provide a drop target which is capable of serving as a ball ramp.

These and other objects and advantages of the present invention will be apparent from the remaining portion of the specification and the drawings.

SUMMARY OF THE INVENTION

The invention solves the above-mentioned problems by incorporating a ramp function into a drop target. The ramp may be accessed by the game ball only after the drop target has been hit and lowered. The ramp may be positioned to provide the only access to an elevated playfield or other elevated feature. A plurality of drop targets may be provided in a row to provide a ramp of increased width and thereby make it easier for the player to access the elevated feature.

DETAILED DESCRIPTION OF THE PREFERRED EMBODIMENT

Figure 1:
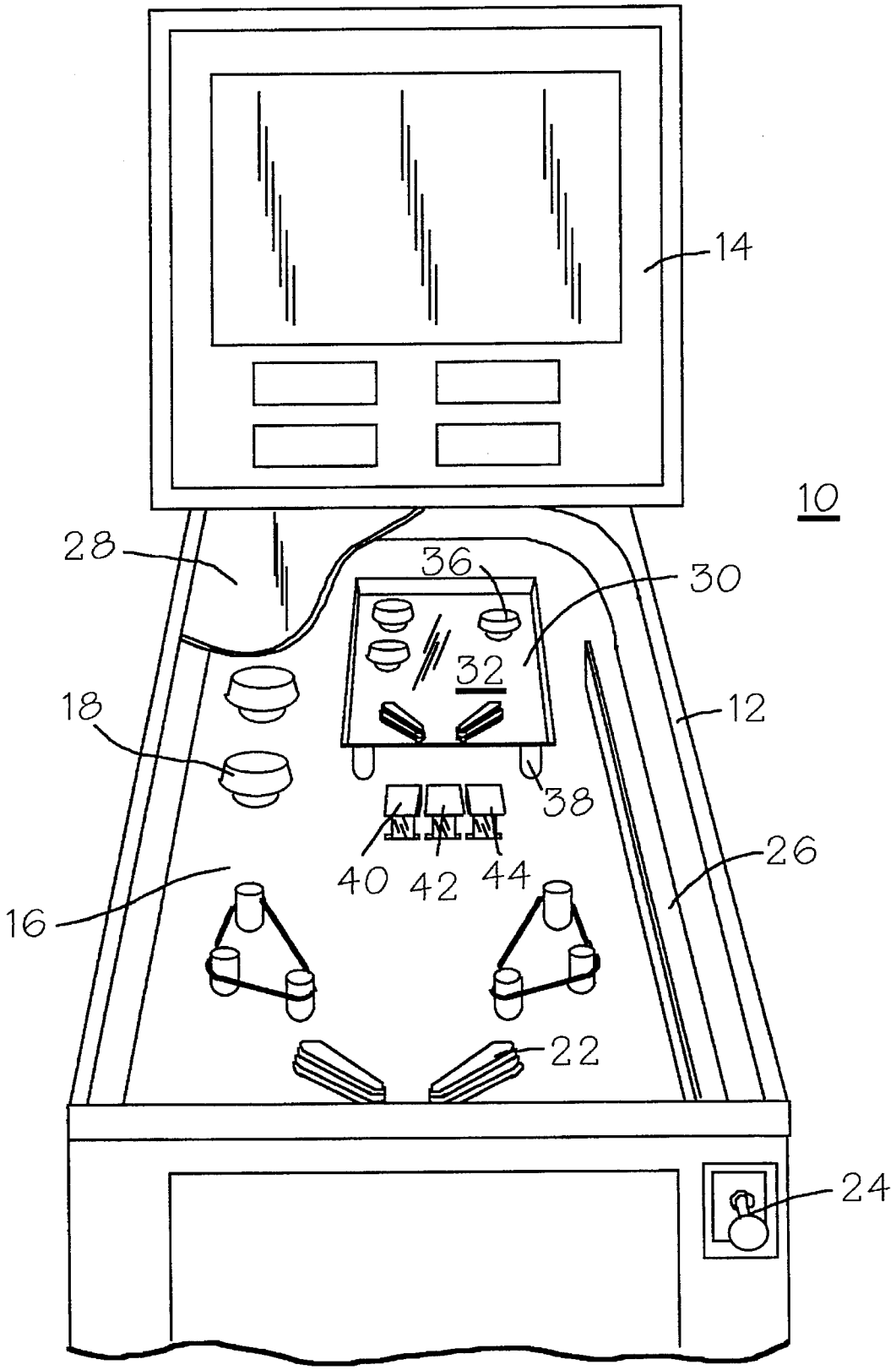
FIG. 1 is a plan view of a pinball machine incorporating a preferred embodiment of the present invention.

Referring to FIG. 1, there is shown a typical rolling ball game or pinball machine 10. The machine comprises a pinball cabinet 12 including a back box 14 for displaying the game score. The cabinet houses an inclined playfield 16 which includes thereon a number of playfield accessories such as target elements 18 and flippers 22. Game play is initiated by activating plunger element 24 to shoot the game ball up alley 26 onto the playfield. A glass sheet 28 allows the player to view the playfield within the game cabinet. Shown in FIG. 1 is an elevated game feature 30 which includes an elevated playfield 32 having flipper elements 34 and other playfield features which may include for example, bumper elements 36. The elevated playfield 32 is supported on support elements 38 above the main playfield 16 at a distance which may allow the game ball to roll beneath the elevated playfield 32, to activate other devices (not shown) which may be mounted on the main playfield beneath the elevated playfield 32.

FIG. 1 shows three target elements 40, 42 and 44 which embody the present invention. It is to be understood that any number of such target elements may be included on the playfield. Elevated playfield 32 is itself inclined with respect to the horizontal so that the game ball, when given access to the elevated playfield, rolls towards flipper elements 34 thus, requiring the player to activate these flippers in order to keep the game ball on the elevated playfield 32. The only access to the elevated play feature 30 in the illustrated embodiment is provided by target elements 40, 42, and 44. Typically, the target elements are of a width equal to the pinball diameter or greater. Thus, providing target elements in a row as shown in FIG. 1, provides a larger ramp for the game ball to engage and increases ball accessibility to the elevated playfield 32. Of course, only a single dual function drop target may be placed on the playfield to challenge the player and provide a difficult shot to the elevated play feature. Moreover, although an elevated playfield is illustrated in FIG. 1, the ramp may provide access to other elevated play features as well, including wireforms and other ramps.

Figure 2:
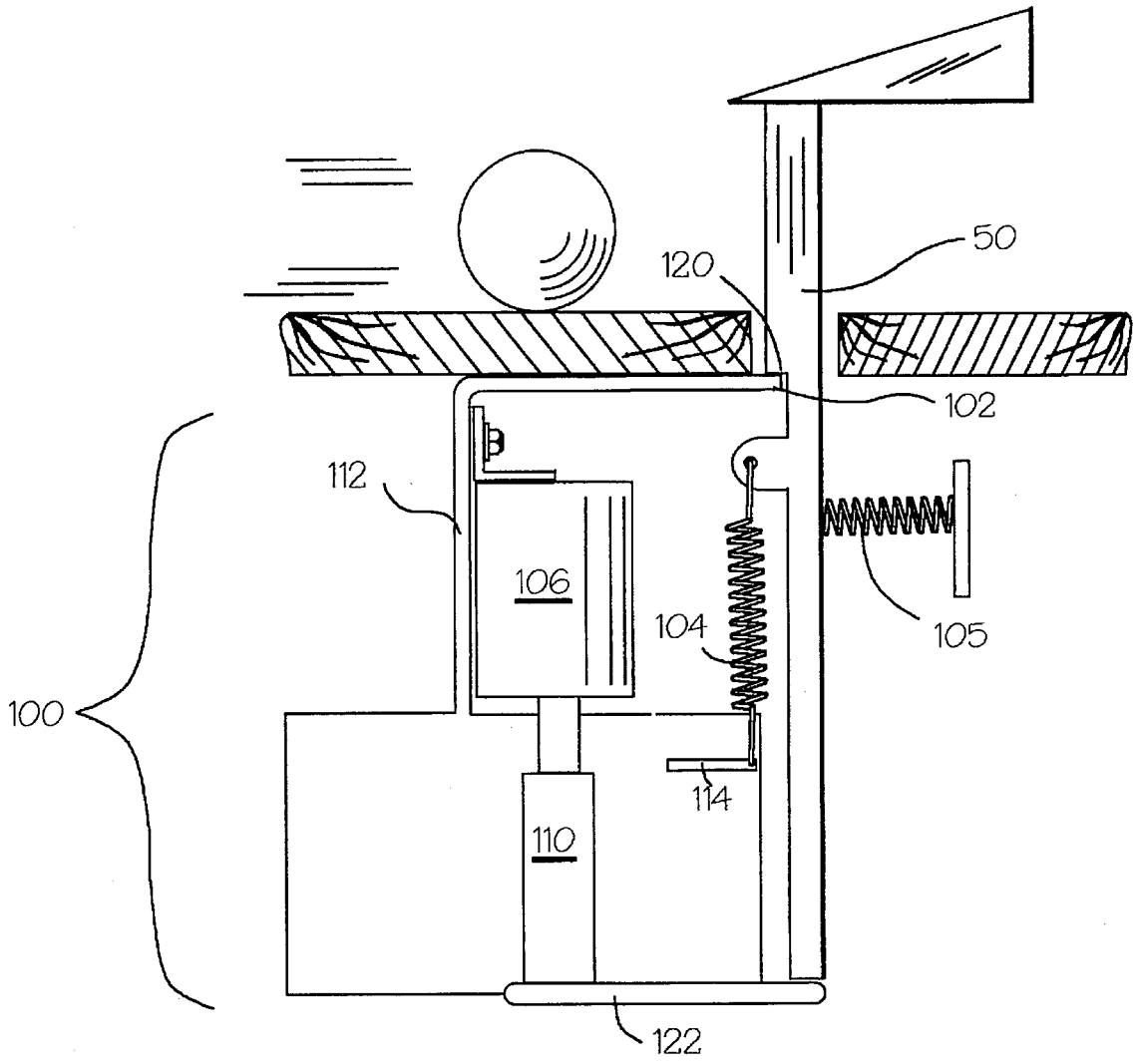
FIG. 2 is a side view of a preferred embodiment of the present invention showing the drop target and ramp element in the raised position.
Figure 3:
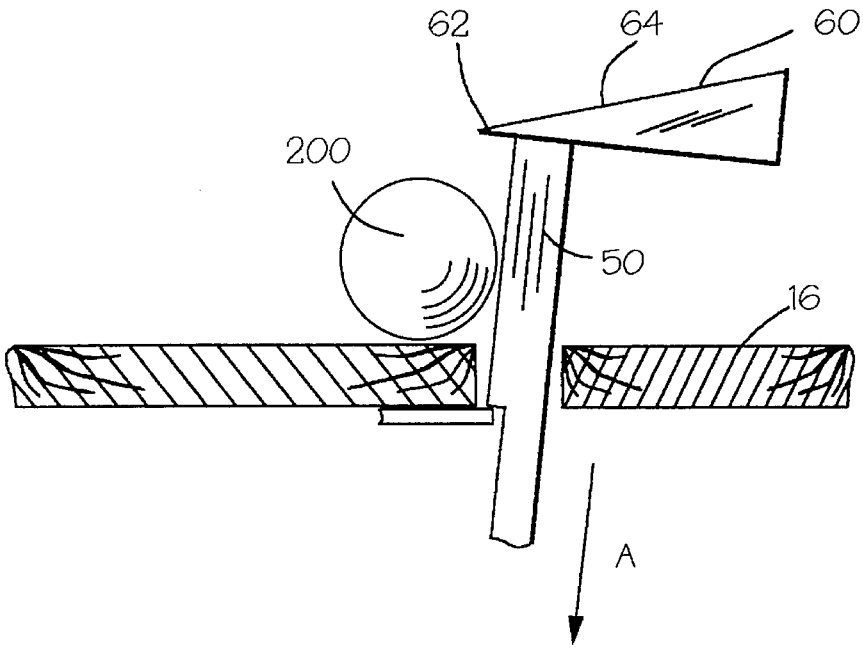
FIG. 3 is a side view of the preferred embodiment of the present invention showing the drop target being activated by the game ball.
Figure 4:
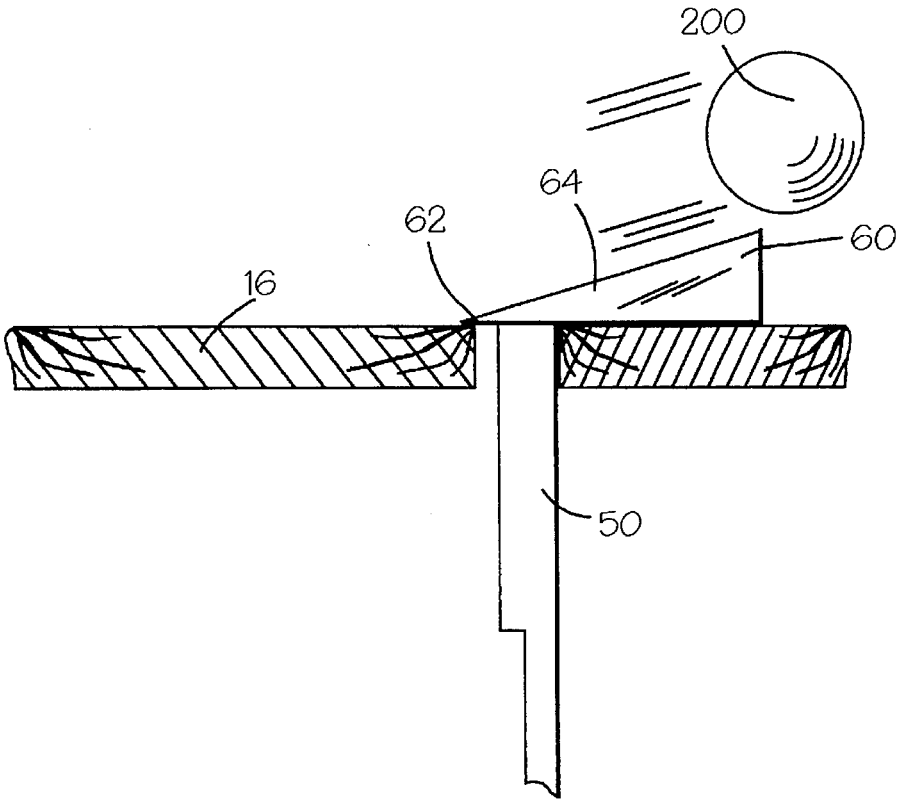
FIG. 4 is a side view showing the game ball being elevated by the ramp element with the drop target in its lowered position.

Operation of the device is depicted in FIGS. 2–4. Referring to FIG. 2, target element 50 is shown in its raised position above the playfield 16. Target element 50 extends below the playfield and is linked to a mechanical device, known in the prior art, for retracting and resetting the target member 50. The resetting device 100 is shown in FIG. 2. It comprises essentially a solenoid 106 fixed to a bracket 112 which is fastened to the underside of the playfield. An end 102 of bracket 112 provides a catch 12 that engages a recess 120 on the target member. Spring element 104 biases target member in a downward direction and is affixed to bracket 112 via a projection 114. When the target is struck by the pinball, recess 120 is disengaged from catch 102 and spring 104 pulls the target member below the playfield. Target member 50 is reset to its raised position by solenoid 106 via reset bar 122. Member 110 lifts reset bar 122 when the target is in its lowered position, thereby raising the target member. Retaining spring 105 provides lateral force to keep target member 50 against catch 102. The resetting device described is known in the prior art and its description is included herein to enable those of ordinary skill to ascertain the construction of a preferred embodiment of the present invention. For example, U.S. Pat. No. 4,257,604 to Grabel et al. discloses a similar resetting device and is hereby incorporated by reference. The retracting and resetting mechanism permits the catch to release when the target is struck as shown in FIG. 3 and moved to an angled position to release the catch mechanism and allowing the target member to slide in the direction of arrow A to its lowered position on the playfield.

Ramp element 60 is provided on the top of the target member as shown in FIGS. 2–4. FIG. 2 depicts ramp apex 62 in a slightly forward position with respect to the target member 50. It is to be understood, however, that the ramp element may be positioned anywhere with respect to the target member 50 so long as action of the target member in moving to its lowered position does not hinder the travel of the game ball. Moreover, although ramp element is depicted as having a planar upper surface 64, it is to be understood that the ramp may embody any surface shape which imparts a vertical force to the game ball as it rolls over the ramp.

FIG. 4 shows the target member in its lowered position whereby the apex of the ramp element is flush with the game playfield 16, thereby providing a smooth transition as the ball travels from the playfield to the ramp surface. Game ball 200 is shown having traveled over the ramp element and is thus vertically displaced and traveling with enough upward velocity to gain access to the elevated play feature.

There has thus been disclosed a novel pinball game feature which permits access to an elevated play feature of the simple construction, and utilizing existing structures on the game playfield. Although preferred embodiments have been described and shown and the above-description, it will be understood by those of ordinary skill in the art that the description and illustrations are merely examples and that the invention is of a scope defined by the claims that follow.

What is claimed is:

1. A rolling ball game having an inclined playfield housed within a game cabinet and at least one game ball operatively associated with said playfield comprising:

a) an elevated play feature mounted on said playfield;

b) a drop target including;

i) a target member;

ii) means for moving said target member between a raised position, in which said target member projects above said playfield, and a lowered position in which said target member is lowered within said playfield;

iii) ramp means, disposed on said target member, for elevating said at least one game ball when said target member is in said lowered position;

wherein said at least one game ball is capable of accessing said elevated play feature only via said ramp means.

2. A dual function drop target for a rolling ball game including a playfield comprising:

a) a target member including a generally vertical support;

b) means for moving said target member between a raised position, in which said target member is disposed above said playfield and a ball can strike the vertical support, and a lowered position in which said vertical support is lowered within said playfield;

c) said target member being configured to function as a ramp in said lowered position to elevate a ball above the playfield.

3. The dual function drop target of claim 1, wherein said ramp is provided on a top portion of said target member such that said ramp is juxtaposed to said playfield when said target member is in said lowered position.

4. The dual function drop target of claim 1, wherein said ramp comprises a planar ramp element surface.

5. The dual function drop target of claim 1, wherein said ramp comprises an apex which is flush with said game playfield when said target member is in said lowered position.

6. A rolling ball game accessory for a rolling ball game having an inclined playfield housed within a game cabinet and at least one game ball operatively associated with said playfield, said accessory comprising a plurality of drop targets disposed on said playfield and each including:

a) a target member;

b) means for moving said target member between a raised position, in which said target member projects above said playfield, and a lowered position in which said target member is lowered within said playfield;

c) ramp means, disposed on said target member, for elevating said at least one game ball when said target member is in said lowered position;

wherein said plurality of drop targets are arranged in a row such that all of said ramp means form a large ramp when all of said target members are in their lowered positions.

* * * * *

UNITED STATES PATENT AND TRADEMARK OFFICE

CERTIFICATE OF CORRECTION

PATENT NO. : 5,516,103
DATED : May 14, 1996
INVENTOR(S) : Patrick Lawlor, et. al.

It is certified that error appears in the above-indentified patent and that said Letters Patent is hereby corrected as shown below:

Column 4, claim 3, line 1, "claim 1 " should be --claim 2--.
claim 4, line 1, "claim 1" should be --claim 2--.
claim 5, line 1, "claim 1 " should be --claim 2--.

Signed and Sealed this

Twenty-second Day of October, 1996

*Attest:*

Bruce Lehman

BRUCE LEHMAN

*Attesting Officer*

*Commissioner of Patents and Trademarks*